US005120773A

United States Patent [19]

Fischer et al.

[11] Patent Number: 5,120,773

[45] Date of Patent: Jun. 9, 1992

[54] WET STRENGTH RESIN COMPOSITION AND METHOD OF MAKING SAME

[75] Inventors: Stephen A. Fischer, Yardley; Reuben H. Grinstein, Blue Bell, both of Pa.

[73] Assignee: Henkel Corporation, Ambler, Pa.

[21] Appl. No.: 801,979

[22] Filed: Dec. 3, 1991

Related U.S. Application Data

[62] Division of Ser. No. 447,278, Dec. 7, 1989.

[51] Int. Cl.[5] ..... C08L 63/00

[52] U.S. Cl. ..... 523/400; 523/402; 523/407

[58] Field of Search ..... 523/400, 402, 407

[56] References Cited

U.S. PATENT DOCUMENTS 3,894,944 7/1975 Panzer et al. ..... 210/736
3,894,945 7/1975 Panzer et al. ..... 210/736
3,894,946 7/1975 Panzer et al. ..... 210/736
3,894,947 7/1975 Panzer et al. ..... 210/736
4,076,673 2/1978 Burkholder, Jr. et al. ..... 524/389
4,132,695 1/1979 Burkholder ..... 524/547

FOREIGN PATENT DOCUMENTS 2307011 11/1976 France .

*Primary Examiner*—Samuel A. Acquah
*Attorney, Agent, or Firm*—Ernest G. Szoke; Wayne C. Jaeschke; John E. Drach

[57] ABSTRACT

An amine-epichlorohydrin resin is prepared in a water-polyol solvent in order to facilitate the polymerization and crosslinking reactions. The reaction product is useful as a wet strength resin composition which has a flash point high enough to be used in commercial paper making operations.

7 Claims, No Drawings

WET STRENGTH RESIN COMPOSITION AND METHOD OF MAKING SAME

BACKGROUND OF THE INVENTION

1. Field of the Invention

This invention relates to wet strength resin compositions and a method for making them.

2. Description of the Related Art

Polyamine-epichlorohydrin resins have been used as wet strength resins for paper since the early 1950's. These resins are cationic by virtue of the fact that they contain quaternary ammonium functionalities and are, therefore, substantive to negatively charged cellulose pulp fibers. These resins are particularly useful because they are formaldehyde-free and develop wet strength at neutral or alkaline pH values. The polyamine-epichlorohydrin resins are normally made by reacting epichlorohydrin and a polyamine such as ethylenediamine, triethylenetetramine, bishexamethylenetriamine, and amine still bottoms which is a mixture of polyamines containing from about 35% to about 70% by weight bishexamethylenetriamine. While the reaction is usually carried out in water, U.S. Pat. Nos. 3,894,944; 3,894,945; Re. No. 28, 807; 3,894,946, 3,894,947, disclose that a water soluble alcohol may be used in place of part of the water. However, these patents also disclose that it is generally preferred to use water alone for economic reasons. U.S. Pat. No. 2,595,935 discloses the use of a water miscible solvent such as ethanol. The use of simple alcohols such as methanol and ethanol as cosolvents has been found to be unacceptable when polyamine-epichlorohydrin resin solutions are used as wet strength resin compositions because these alcohols have low flash points and they remain in the final product. It would be desirable, therefore, to use an alcohol that has a flash point high enough for use in commercial paper making operations and one that is not a health and safety hazard to those who handle it or those who use products produced by wet strength formulations containing it.

SUMMARY OF THE INVENTION

The present invention provides a wet strength resin composition comprising from about 48 weight % to about 89 weight % water, from about 1.0 weight % to about 7.0 weight % of at least one polyol, and from about 10 weight % to about 45 weight % of a polyamine-epichlorohydrin resin.

The present invention also provides a method of making a polyamine-epichlorohydrin resin comprising the steps of: (a) providing a water-polyol-polyamine solution; (b) adding to said solution epichlorohhydrin at a rate sufficient to maintain the temperature of said solution in a range of from about 5° C. to about 15° C. to form a reaction mixture having an E/N ratio of from about 1.0 to about 1.4; (c) maintaining the temperature of said reaction mixture in a range of from about 50° C. to about 80° C. until a 35% solids solution of said reaction mixture has a viscosity of at least about 70 cps; and (d) adjusting the pH of said reaction mixture to from about 2 to about 3 with an aqueous acid solution.

DESCRIPTION OF THE PREFERRED EMBODIMENTS

One aspect of the present invention provides a wet strength resin composition for increasing the wet strength of cellulosic webs comprising from about 48 weight % to about 89 weight % water, from about 1.0 weight % to about 7.0 weight % of at least one polyol, and from about 10 weight % to about 45 weight % of a polyamine-epichlorohydrin resin.

The wet strength resin composition of the present invention is made by the process disclosed herein where an amine-epichlorohydrin resin is made by reacting a polyamine and epichlorohydrin in an aqueous polyol solution. A polyamine is any amine that has at least two amine functionalities such as a simple diamine as ethylene diamine or more than two amine functionalities such as diethylene triamine, triethylenetetramine, and bishexamethylenetriamine and the like. Preferably, the polyamine is a mixture of polyamines known as amine still bottoms which is a mixture of polyamines containing from about 35% by weight to about 70% by weight bishexamethylenetriamine. It has been found that at least one polyol is a necessary component of the reaction because it performs the dual function of a cosolvent and a moderator of the cross-linking reaction. The polyol component of the wet strength composition can be any aliphatic compound having 2 or more hydroxyl functionalities that is miscible with water or combinations thereof. Examples of such polyols include ethylene glycol, 1,2-propylene glycol, 1,3-propylene glycol, diethylene glycol, dipropylene glycol, triethylene glycol, 1,6-hexylene glycol, glycerol, monosaccharides such as glucose or fructose, disaccharides such as sucrose, and polyvinyl alcohol. The preferred polyols are 1,2-propylene glycol and dipropylene glycol because they are generally recognized as safe, have flash points >200° C., and are good cosolvents for the amine-epichlorohydrin reaction. A preferred wet strength resin composition contains about 60.2% by weight water, about 4.8% by weight of 1,2-propylene glycol, and about 35% by weight of a polyamine-epichlorohydrin resin.

Another aspect of the present invention provides a process for making a polyamine-epichlorohydrin resin comprising the steps of: (a) providing a water-polyol-polyamine solution; (b) adding to said solution epichlorohhydrin at a rate sufficient to maintain the temperature of said solution in a range of from about 5° C. to about 15° C. to form a reaction mixture having an E/N ratio of from about 1.0 to about 1.4; (c) maintaining the temperature of said reaction mixture in a range of from about 50° C. to about 80° C. until a 35% solids solution of said reaction mixture has a viscosity of at least about 70 cps; and (d) adjusting the pH of said reaction mixture to from about 2 to about 3 with an aqueous acid solution. The process of the present invention is generally carried out by first preparing a water-polyol-polyamine solution containing from about 41 weight % to about 59 weight % water, from about 10 weight % to about 16 weight % of at least one polyol, from about 31 weight % to about 43 weight % polyamine. It is preferred that the polyamine be an aqueous solution containing about 50% by weight polyamine and having a total alkalinity of from about 33% to about 43%. The resulting water-polyol-polyamine solution is then mixed while cooling to 5° C. until it is a single phase. The epichlorohydrin is then added at a rate sufficient to maintain the temperature of the solution in a range of from about 5° C. to about 15° C., preferably 5° C. to about 10° C. to form a reaction mixture having an E/N ratio of from about 1.0 to about 1.4. The E/N ratio is defined as $$\frac{\text{wt of epichlorohydrin/wt of amine bottoms solution}}{\text{(total alkalinity of amine bottoms solution/5611)}} \times 92.53.$$

The total alkalinity is the number of equivalents of HCl required to neutralize 1.0 gram of polyamine. The E/N ratio can vary from about 1.0 to about 1.4 and is preferably 1.15 to 1.4. The absolute amount of amine+epichlorohydrin can be from about 52% by weight to about 64% by weight of the reaction mixture with about 56%-59% by weight being the preferred amount. The reaction is allowed to proceed in a temperature range of from about 50° C. to about 80° C., preferably from about 60° C. to about 70° C., until a 35% solids solution has a viscosity of at least 70 cps (Brookfield, spindle #2 @ 160 r.p.m., 25° C.). The 35% solids solution is formed by diluting the reaction mixture with water until the non-volatile solids reaches about 35% by weight. The reaction is then quenched by adding water to bring the total solids to about 35% and the pH is adjusted to about 2-3 by addition of aqueous acid preferably 31.5% aqueous HCl.

In a preferred embodiment, a water-polyol-polyamine solution is prepared containing about 141.9 grams of a 51.5% solids amine bottoms solution having a total alkalinity of 36.08%, 32.4 grams of water and 23.8 grams of 1,2-propylene glycol. The Water-polyol-polyamine solution is placed in a reactor, mixed until uniform, and cooled to 5° C. A total of 99.7 grams of epichlorohydrin is then added at a rate sufficient to maintain the reaction temperature between 5°-15° C. The E/N ratio is 1.18. After all the epichlorohydrin is added, the reaction mass is allowed to exotherm freely to 55° C. and held there until the viscosity at 35% solids solution reaches about 82 cps (Brookfield, spindle #2 @ 160 r.p.m., 25° C.). The reaction mass is then quenched by adding water and 31.5% aq. HCl. The pH and the solids of the reaction mass is then adjusted to 3.1 and 35% respectively. The composition has a flash point (PMCC) of >200° F.

The following examples will serve to illustrate but not limit the invention.

EXAMPLE 1

Preparation of polyamine-epichlorohydrin resin-Water-Propylene Glycol Solvent Added to a suitable reactor was 141.9 parts of an amine bottoms solution having a total alkalinity of 36.08% and a solids content of 51.5%. Also charged were 32.4 parts of water and 23.8 parts of propylene glycol. The contents of the reactor were mixed until uniform, cooled to 5° C., at which time the epichlorohydrin was added over a 12 hour period. The temperature was controlled between 5°- 15° C. during the addition of 81.8 parts of epichlorohydrin. During the last 18 minutes of the epichlorohydrin feed, the cooling was shut-off and 17.9 parts of epichlorohydrin was added. The reaction mass was allowed to exotherm freely to 55° C. The reaction mass was held at 55° C. until the viscosity at 35% solids was 82.5 cps. The reaction mass was quenched by adding water and 31.5% aq. HCl. The pH and the solids of the reaction mass was adjusted to 3.1 and 35% respectively. The flash point (PMCC) of the resin was >200° F.

EXAMPLE 2

Preparation of Polyamine-Epichlorohydrin Resin-Water-Propylene Glycol Solvent Added to a suitable reactor was 141.9 parts of an amine bottoms solution having a total alkalinity of 34.84% and a solids content of 47.05%. Also charged were 29.9 parts of water and 24.7 parts of propylene glycol. The contents of the reactor were mixed until uniform. The contents of the reactor were cooled to 5° C. at which time the epichlorohdyrin was added over a 12 hour period. The temperature was controlled between 5°-15° C. during the addition of 92.25 parts of epichlorohydrin. During the last 18 minutes of the epichlorohydrin feed, the cooling was shut-off and 20.25 parts of epichlorohydrin was added. The reaction mass was allowed to exotherm freely to 60° C. The reaction mass was held at 60°-65° C. until the viscosity at 35% solids was 85 cps. The reaction mass was quenched by adding water and 31.5 aq. HCl. The pH and the solids of the reaction mass was adjusted to 2.9 and 37% respectively. The flash point (PMCC) of the resin was >200° F.

EXAMPLE 3

Preparation of Polyamine-Epichlorohydrin Resin-Water-Ethylene Glycol Solvent Added to a reactor was 121.7 parts of an amine bottoms solution having a total alkalinity of 35.62% and a solids contents of 45.1%. Also charged were 10.6 parts of water and 23.4 parts of ethylene glycol. The contents of the reactor were mixed until uniform while cooling to 6.5° C. 84.3 parts of epichlorohydrin was added over 55 minutes while maintaining the temperature between 5°-15° C. Once all the epichlorohydrin was added, the reaction mass was allowed to exotherm to 80° C. The reaction mass was held at 80° C. until the viscosity at 35% solids reached 105 cps. The reaction mass was quenched by adding water and 31.5% aq. HCl. The pH and the solids of the reaction mass was adjusted to 3.0 and 37.6% respectively.

EXAMPLE 4

Preparation of Polyamine-Epichlorohydrin Resin-Water-Hexylene Glycol Solvent Added to a reactor was 116 parts of an amine bottoms solution having a total alkalinity of 35.62% and a solids content of 50.7%. Also charged were 23.1 parts of water and 20.5 parts of hexylene glycol. The contents of the reactor were mixed until uniform while cooling to 5° C. 80.4 parts of epichlorohydrin was added over 75 minutes while maintaining the temperature between 5°-15° C. Once all the epichlorohydrin was added, the reaction mass was allowed to exotherm to 80° C. The reaction mass was held at 80° C. until the viscosity at 35% solids reached 78 cps. The reaction mass was quenched with water and 31.5% aq HCl. The pH and the solids of the reaction mass was adjusted to 3.0 and 33.5% respectively.

COMPARATIVE EXAMPLE A

This example shows that without the aid of a glycol cosolvent, the reaction mass reacts uncontrollably to yield a water insoluble cross-linked gel.

Preparation of Polyamine-Epichlorohydrin Resin-Water Solvent

Added to a suitable reactor were 80 parts of amine bottoms concentrate and 119 parts of water. The contents of the reactor were mixed together. The % solids and % total alkalinity of the solution was determined as 34.1 and 29.2 respectively. The reaction mass was cooled at 2° C., at which time the epichlorohydrin feed was started. 113 parts of epichlorohydrin was added over a 8.25 hour period while maintaining a temperature of 2°-15° C. Once the epichlorohydrin addition was complete, the cooling was shut-off and the reaction mass freely exothermed to 70° at which point the reaction mass instantly gelled in the reactor.

COMPARATIVE EXAMPLE B

This example shows that a wet strength resin composition comparable to those of Examples 1 and 2 but which contains methanol in place of a glycol has an unacceptable flash point.

Preparation of Polyamine-Epichlorohydrin Resin-Water-Methanol Solvent

Added to a suitable reactor were 80 parts of amine bottoms concentrate, 114.5 parts of water and 33.5 parts of methanol. The contents of the reactor were mixed to form a uniform solution. The % solids and % total alkalinity of the solution was determined as 34.7 and 28.5 respectively. The reaction mass was cooled at 0° C., at which time the epichlorohydrin feed was started. 126 parts of epichlorohydrin was added over a 7.5 hour period while maintaining a temperature of 0°-15° C. Once the epichlorohydrin addition was complete, the cooling was shut-off and the reaction mass freely exothermed to 70°. The reaction mass was held at 70° C. until the viscosity at 35% solids reached 118 cps. The reaction mass was quenched by adding water and concentrated HCl. The pH and solids of the reaction mass was adjusted to 2.8 and 35% respectively. The flash point (PMCC) of the resin was 150° F.

What is claimed is:

1. A wet strength resin composition comprising from about 48 weight % to about 89 weight % water, from about 1.0 weight % to about 7.0 weight % of at least one polyol, and from about 10 weight % to about 45 weight % of a polyamine-epichlorohydrin resin.

2. A wet strength resin composition comprising about 88.6 weight % water, 1.4 weight % of 1,2-propylene glycol, and 10 weight % of a polyamine-epichlorohydrin resin.

3. A wet strength resin composition comprising about 48.8 weight % water, 6.2 weight % of 1,2-propylene glycol, and 45 weight % of a polyamine-epichlorohydrin resin.

4. A wet strength resin composition comprising about 60.2 weight % water, 4.8 weight % of 1,2-propylene glycol, and 35 weight % of a polyamine-epichlorohydrin resin.

5. A wet strength resin composition comprising about 88.6 weight % water, 1.4 weight % of dipropylene glycol, and 10 weight % of a polyamine-epichlorohydrin resin.

6. A wet strength resin composition comprising about 48.8 weight % water, 6.2 weight % of dipropylene glycol, and 45 weight % of a polyamine-epichlorohydrin resin.

7. A wet strength resin composition comprising about 60.2 weight % water, 4.8 weight % of dipropylene glycol, and 35 weight % of a polyamine-epichlorohydrin resin.

* * * * *